US009945311B2

(12) United States Patent
Linker et al.

(10) Patent No.: US 9,945,311 B2
(45) Date of Patent: Apr. 17, 2018

(54) METHOD AND SYSTEMS FOR ADJUSTING FLOW RESISTANCE IN A THERMAL MANAGEMENT SYSTEM DURING AN ENGINE START

(71) Applicant: General Electric Company, Schenectady, NY (US)

(72) Inventors: Ryan Keith Linker, Erie, PA (US); Alexandra Rose Hesse, Lincoln University, PA (US)

(73) Assignee: General Electric Company, Schenectady, NY (US)

( * ) Notice: Subject to any disclaimer, the term of this patent is extended or adjusted under 35 U.S.C. 154(b) by 42 days.

(21) Appl. No.: 15/254,757

(22) Filed: Sep. 1, 2016

(65) Prior Publication Data

US 2018/0058354 A1 Mar. 1, 2018

(51) Int. Cl.

| | |
|---|---|
| ***F02D 43/00*** | (2006.01) |
| ***F01P 7/14*** | (2006.01) |
| ***F02D 41/06*** | (2006.01) |
| ***F01P 11/08*** | (2006.01) |
| *F02D 41/00* | (2006.01) |

(52) U.S. Cl.

CPC ..... *F02D 41/068* (2013.01); *F01P 7/14* (2013.01); *F01P 11/08* (2013.01); *F02D 43/00* (2013.01); *F01P 2007/143* (2013.01); *F01P 2007/146* (2013.01); *F01P 2037/02* (2013.01); *F02D 2041/002* (2013.01)

(58) Field of Classification Search

CPC .. F02D 41/068; F02D 41/2438; F02D 41/083; F01P 2025/62; F01P 2025/64; F01P 2037/02; F01P 2025/40; F01P 2060/00

See application file for complete search history.

(56) References Cited

U.S. PATENT DOCUMENTS 7,953,541 B2 * 5/2011 Roth ..... F02D 41/008 123/73 AD
8,352,161 B2 * 1/2013 Ishii ..... F02D 13/0265 123/179.18

(Continued)

OTHER PUBLICATIONS

U.S. Appl. No. 62/262,283 entitled "Method and System for Calibrating Exhaust Valves"; David Zielinski, General Electric Company; Dec. 2, 2015.

*Primary Examiner* — Long T Tran

(74) *Attorney, Agent, or Firm* — GE Global Patent Operation; John A. Kramer

(57) ABSTRACT

Various methods and systems are provided for a thermal management system of an engine. A method for an engine may comprise adjusting an engine speed during an engine start event that includes an engine cranking activity from a first engine speed to a second engine speed, where the adjusting is based on a sensed oil temperature; adjusting a first resistance of a radiator primary return line of a thermal management system to a first resistance level; and adjusting the engine speed a duration after a start of the engine cranking from the second engine speed to a third engine speed, the third engine speed based at least in part on an engine torque demand, and selectively adjusting the first resistance between each of the first resistance level and a second resistance level based on the third engine speed, the second resistance level being lower than the first resistance level.

20 Claims, 6 Drawing Sheets

(56) References Cited

U.S. PATENT DOCUMENTS

| | | | | |
|---|---|---|---|---|
| 8,831,858 | B2 * | 9/2014 | Roth | F02D 41/008 123/568.12 |
| 9,341,105 | B2 * | 5/2016 | Jentz | F01P 11/14 |
| 2009/0217655 | A1 * | 9/2009 | Yabuki | F01P 7/044 60/456 |
| 2011/0253113 | A1 * | 10/2011 | Roth | F02D 41/008 123/568.12 |
| 2013/0139767 | A1 * | 6/2013 | Koyama | F01P 3/10 123/41.02 |
| 2013/0255599 | A1 * | 10/2013 | Jentz | F01P 11/14 123/41.1 |
| 2013/0340430 | A1 * | 12/2013 | Peters | F02B 37/18 60/611 |
| 2014/0142819 | A1 * | 5/2014 | Pursifull | F01P 11/16 701/51 |
| 2014/0144218 | A1 * | 5/2014 | Rollinger | F01P 7/048 73/114.68 |
| 2015/0285161 | A1 * | 10/2015 | Ulrey | F02D 23/02 477/3 |
| 2016/0040583 | A1 | 2/2016 | Vaughn | |

* cited by examiner

METHOD AND SYSTEMS FOR ADJUSTING FLOW RESISTANCE IN A THERMAL MANAGEMENT SYSTEM DURING AN ENGINE START

BACKGROUND

Technical Field

Embodiments of the subject matter disclosed herein relate to a thermal management system of an engine.

Discussion of Art

To reduce overheating of an engine and related components, a thermal management system (e.g., such as a cooling system) may route engine fluid (e.g., coolant) through a single thermal management circuit that includes the engine, a coolant pump, a radiator, and additional heat exchangers. The thermal management system may have two parallel return paths from the radiator and back to the pump: a radiator main return path (also referred to herein as the primary return path) and sub-cooled return path (also referred to herein as the secondary return path). The secondary return path may include more heat exchangers than the radiator primary return path, thereby increasing a resistance of the secondary return path relative to a resistance of the radiator primary return path. Additionally, one or more of the heat exchangers may be positioned a vertical distance above the coolant pump. The coolant pump may be driven by an engine crankshaft and at lower engine speeds, flow and pressure in the thermal management system may be lower. Additionally, when the engine is shut off, there may not be standing water (or coolant) within the components of the thermal management system in order to reduce the likelihood of freezing. However, upon engine startup, air within the thermal management system may cause the coolant pump to not build enough pressure. Thus, during an engine starting event (e.g., which includes engine cranking), the coolant pump may not provide enough pressure to move the water/air mixture and flood all the components of the thermal management system. This may cause thermal gradients to form across the un-flooded heat exchangers, thereby resulting in component degradation and non-homogenous temperatures in the thermal management system.

BRIEF DESCRIPTION

In one embodiment, a method for an engine (e.g., a method for controlling an engine system) comprises adjusting an engine speed of the engine during an engine start event that includes an engine cranking activity from a first engine speed to a second engine speed, where the adjusting is based at least in part on a sensed oil temperature; adjusting a first resistance of a radiator primary return line of a thermal management system of the engine to a first resistance level; and adjusting the engine speed a duration after a start of the engine cranking from the second engine speed to a third engine speed, the third engine speed based at least in part on a torque demand of the engine, and selectively adjusting the first resistance between each of the first resistance level and a second resistance level based at least in part on the third engine speed, the second resistance level being lower than the first resistance level.

DETAILED DESCRIPTION

The following description relates to embodiments of adjusting an engine speed of an engine during an engine start event that includes an engine cranking activity from a first engine speed to a second engine speed, where the adjusting is based at least in part on a sensed oil temperature; adjusting a first resistance of a radiator primary return line of a thermal management system of the engine to a first resistance level; and adjusting the engine speed a duration after a start of the engine cranking from the second engine speed to a third engine speed, the third engine speed based at least in part on a torque demand of the engine, and selectively adjusting the first resistance between each of the first resistance level and a second resistance level based at least in part on the third engine speed, the second resistance level being lower than the first resistance level. In one example, adjusting the first resistance of the radiator primary return line includes adjusting a position of a controller-actuatable valve disposed in the radiator primary return line. In another example, adjusting the first resistance of the radiator primary return line includes adjusting a position of a controller-actuatable valve disposed in a secondary return path including one or more heat exchangers and positioned in parallel with the radiator primary return line. The radiator primary return line may include fewer heat exchangers than the secondary return path.

Figure 1:
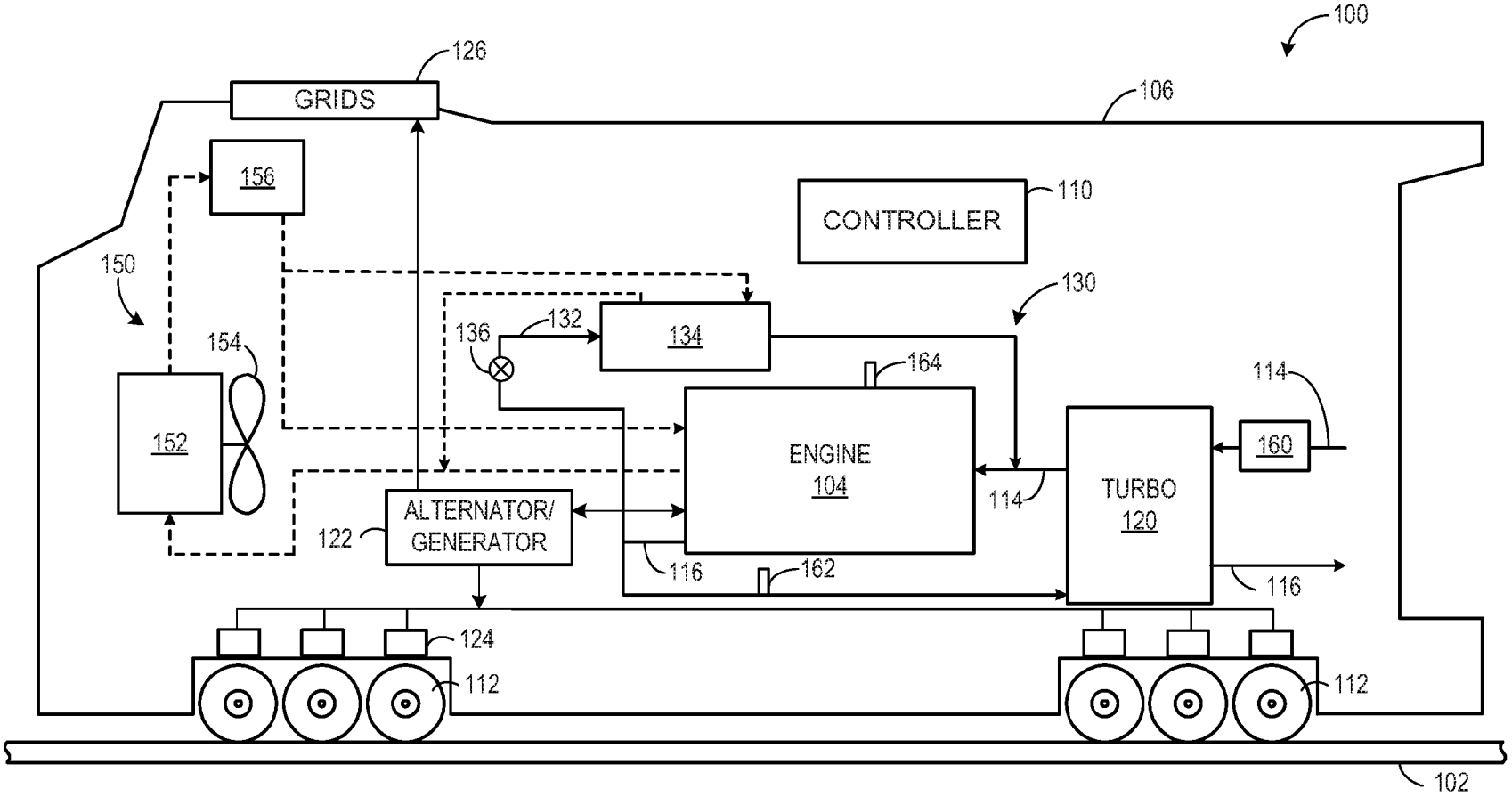
FIG. 1 shows a schematic diagram of a rail vehicle with an engine according to an embodiment of the invention.
Figure 2A:
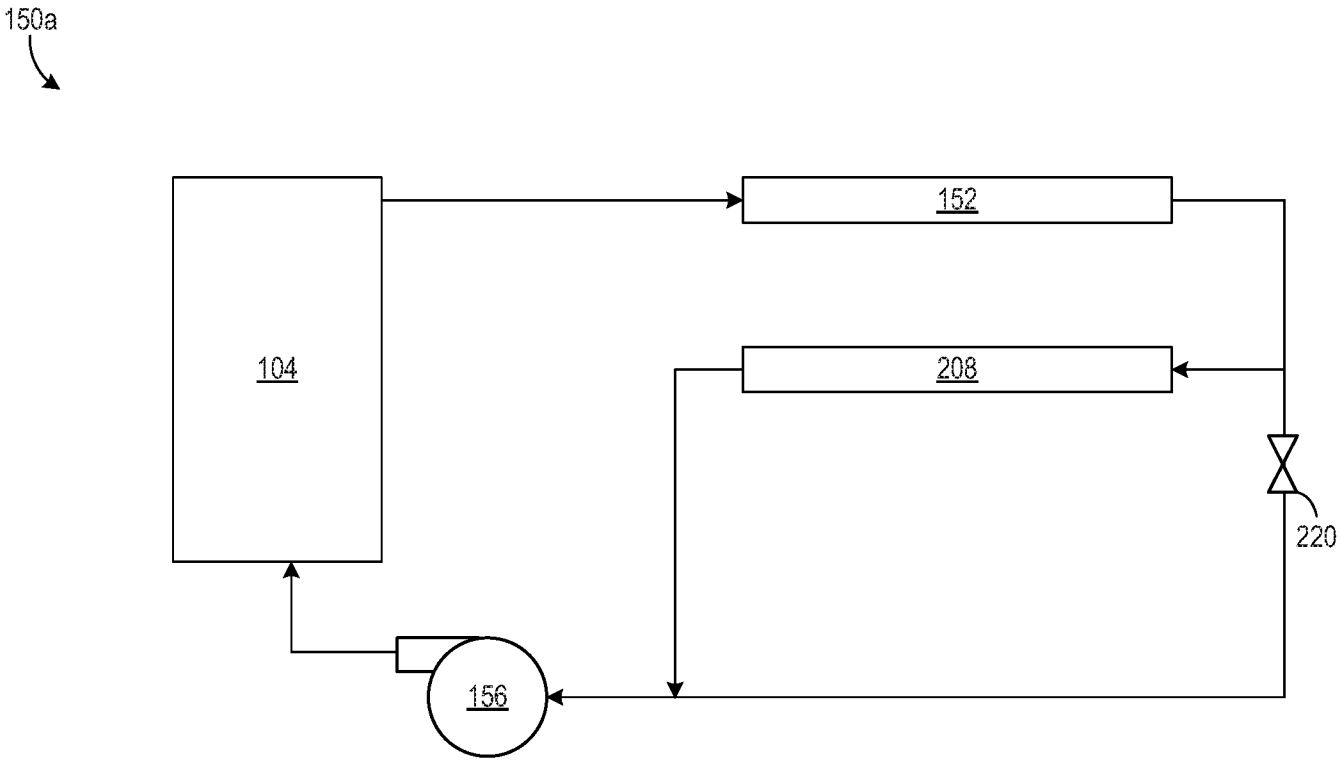
FIG. 2A shows a schematic of a thermal management system of an engine system according to an embodiment of the invention.
Figure 2B:
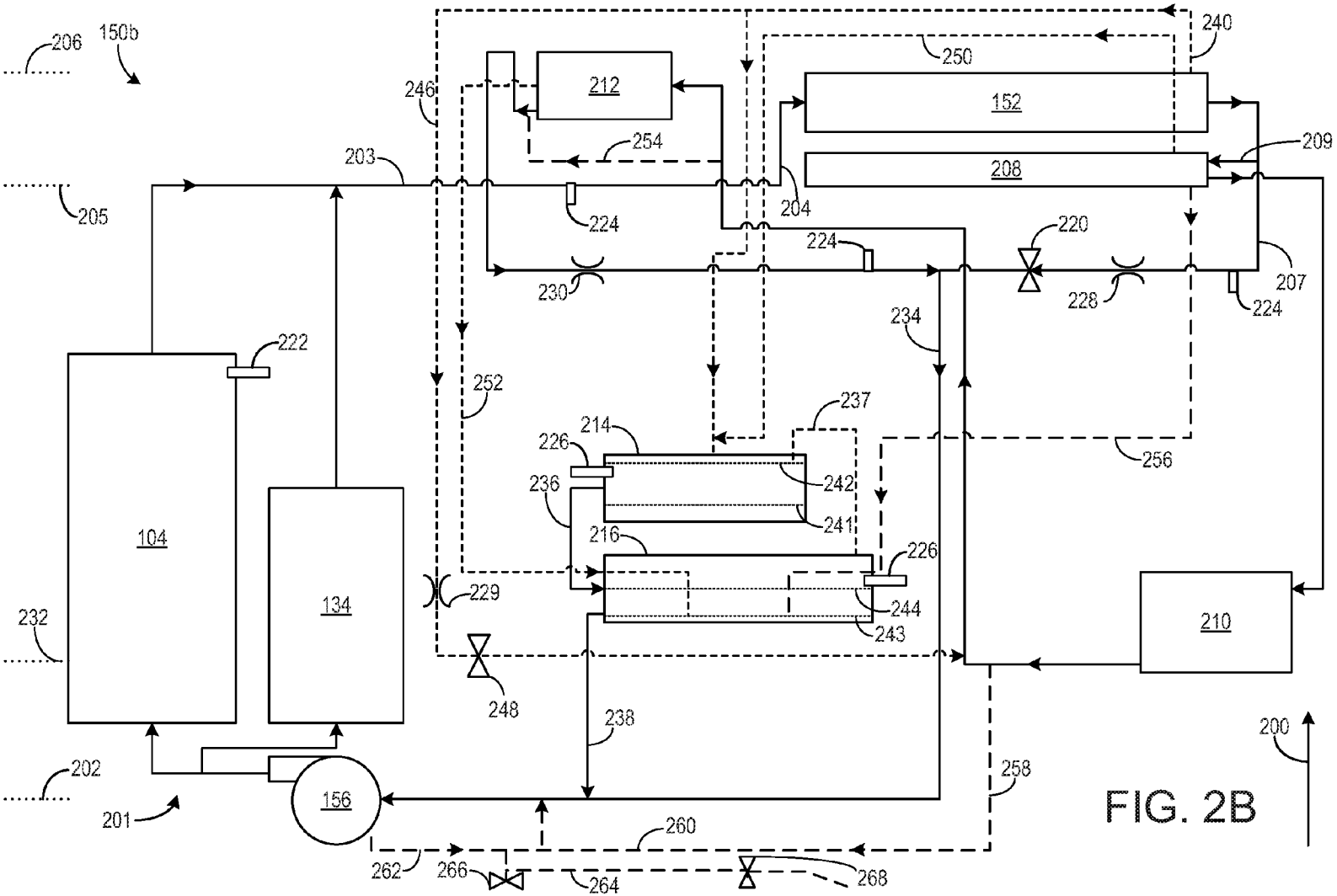
FIG. 2B shows a schematic of a thermal management system of an engine system according to another embodiment of the invention.
Figure 5:
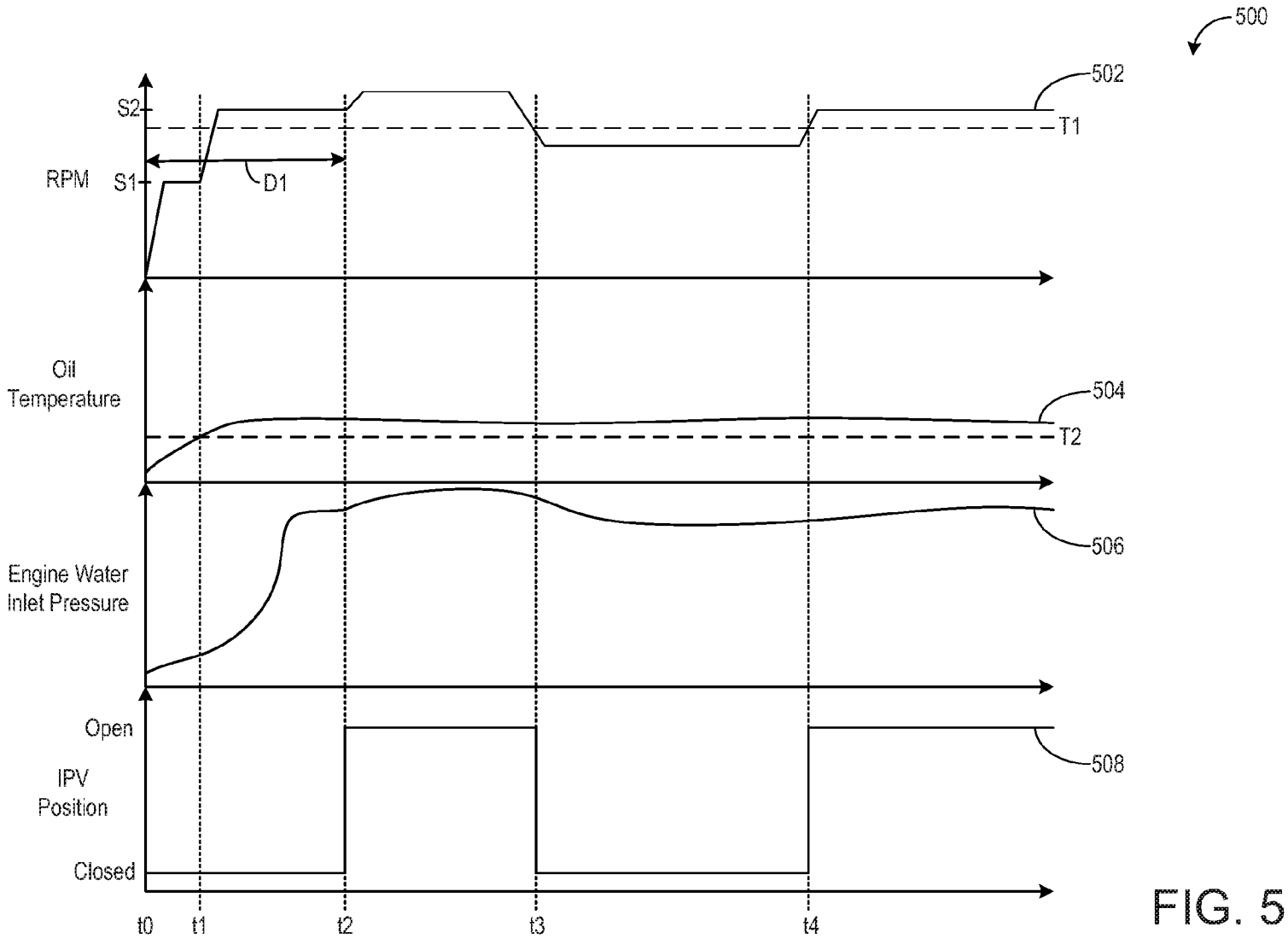
FIG. 5 shows a graph illustrating changes in engine speed and a position of the restrictive element of the thermal management system during an engine start event according to an embodiment of the invention.

One embodiment of a vehicle in which the engine may be installed is shown in FIG. 1. The engine is cooled with a thermal management (e.g., engine cooling) system, such as the thermal management system of FIGS. 2A and/or 2B. As shown in FIGS. 2A and 2B, the thermal management system includes a pump flowing fluid to a radiator and then to two parallel return paths coupled between the radiator and the pump. In one example, the higher resistance path of the two parallel return paths may be a secondary return path including one or more heat exchangers and the other return path is a radiator primary return line including fewer heat exchangers than the secondary return path. The resistance of the two parallel return paths may be adjusted with a restrictive element positioned in one or more of the parallel return paths. In one example, the restrictive element is a valve, such as the butterfly valve shown in FIG. 3. Further, during an engine start event, an engine controller may adjust engine speed and a position of the restrictive element to allow fluid (e.g., coolant) to flood the components of the thermal management system. FIG. 5 shows example adjustments to engine speed and a position of the restrictive element based on engine operating conditions during an engine start event.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Before further discussion of the approach for adjusting engine speed and the resistance of a radiator primary return line relative to the resistance of a secondary return line in a thermal management system during an engine start event, an example of a platform is disclosed in which an engine and thermal management system may be configured for a vehicle, such as a rail vehicle. For example, FIG. 1 shows a block diagram of an embodiment of a vehicle system 100, herein depicted as a rail vehicle 106 (e.g., locomotive), configured to run on a rail 102 via a plurality of wheels 112. As depicted, the rail vehicle includes an engine 104. In other non-limiting embodiments, the engine may be a stationary engine, such as in a power-plant application, or an engine in a marine vessel or other off-highway vehicle propulsion system as noted above.

The engine receives intake air for combustion from an intake passage 114. The intake passage receives ambient air from an air filter 160 that filters air from outside of the rail vehicle. Exhaust gas resulting from combustion in the engine is supplied to an exhaust passage 116. Exhaust gas flows through the exhaust passage, and out of an exhaust stack of the rail vehicle. In one example, the engine is a diesel engine that combusts air and diesel fuel through compression ignition. In another example, the engine is a dual or multi-fuel engine that may combust a mixture of gaseous fuel and air upon injection of diesel fuel during compression of the air-gaseous fuel mix. In other non-limiting embodiments, the engine may additionally combust fuel including gasoline, kerosene, natural gas, biodiesel, or other petroleum distillates of similar density through compression ignition (and/or spark ignition).

In one embodiment, the rail vehicle is a diesel-electric vehicle. As depicted in FIG. 1, the engine is coupled to an electric power generation system, which includes an alternator/generator 122 and electric traction motors 124. For example, the engine is a diesel and/or natural gas engine that generates a torque output that is transmitted to the alternator/generator which is mechanically coupled to the engine. In one embodiment herein, the engine is a multi-fuel engine operating with diesel fuel and natural gas, but in other examples the engine may use various combinations of fuels other than diesel and natural gas.

The alternator/generator produces electrical power that may be stored and applied for subsequent propagation to a variety of downstream electrical components. As an example, the alternator/generator may be electrically coupled to a plurality of traction motors and the alternator/generator may provide electrical power to the plurality of traction motors. As depicted, the plurality of traction motors are each connected to one of the plurality of wheels to provide tractive power to propel the rail vehicle. One example configuration includes one traction motor per wheel set. As depicted herein, six traction motors correspond to each of six pairs of motive wheels of the rail vehicle. In another example, alternator/generator may be coupled to one or more resistive grids 126. The resistive grids may be configured to dissipate excess engine torque via heat produced by the grids from electricity generated by alternator/generator.

The alternator/generator may also include or act as a starter motor during an engine start event. For example, during an engine start event, the alternator/generator may apply stored electrical energy to the engine to enable engine cranking. Specifically, in one embodiment, the starting system of the alternator/generator may include a battery that provides direct current (DC) power to an inverter that converts the DC power into a controlled frequency alternating current (AC) power. The AC power is then supplied to a stator of an alternator that generates rotation of a rotor, which when coupled with the crankshaft of the engine, rotates the crankshaft for engine starting.

In some embodiments, the vehicle system may include a turbocharger 120 that is arranged between the intake passage and the exhaust passage. The turbocharger increases air charge of ambient air drawn into the intake passage in order to provide greater charge density during combustion to increase power output and/or engine-operating efficiency. The turbocharger may include a compressor (not shown) which is at least partially driven by a turbine (not shown). While in this case a single turbocharger is included, the system may include multiple turbine and/or compressor stages. Additionally or alternatively, in some embodiments, a supercharger may be present to compress the intake air via a compressor driven by a motor or the engine, for example. Further, in some embodiments, a charge air cooler (e.g., water-based intercooler) may be present between the compressor of the turbocharger or supercharger and intake manifold of the engine. The charge air cooler may cool the compressed air to further increase the density of the charge air.

In some embodiments, the vehicle system may further include an aftertreatment system coupled in the exhaust passage upstream and/or downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, three-way catalyst, $NO_x$ trap, or various other devices or systems.

The vehicle system may further include an exhaust gas recirculation (EGR) system 130 coupled to the engine, which routes exhaust gas from the exhaust passage of the engine to the intake passage downstream of the turbocharger. In some embodiments, the exhaust gas recirculation system may be coupled exclusively to a group of one or more donor cylinders of the engine (also referred to a donor cylinder system). As depicted in FIG. 1, the EGR system includes an EGR passage 132 and an EGR cooler 134 to reduce the temperature of the exhaust gas before it enters the intake passage. By introducing exhaust gas to the engine, the amount of available oxygen for combustion is decreased, thereby reducing the combustion flame temperatures and reducing the formation of nitrogen oxides (e.g., NOR).

In some embodiments, the EGR system may further include an EGR valve for controlling an amount of exhaust gas that is recirculated from the exhaust passage of the engine to the intake passage of the engine. The EGR valve may be an on/off valve controlled by a controller 110, or it may control a variable amount of EGR, for example. As shown in the non-limiting example embodiment of FIG. 1, the EGR system is a high-pressure EGR system. In other embodiments, the vehicle system may additionally or alternatively include a low-pressure EGR system, routing EGR from downstream of the turbine to upstream of the compressor.

As depicted in FIG. 1, the vehicle system further includes a thermal management system 150 (e.g., engine cooling system). The thermal management system circulates fluid (e.g., coolant) through the engine to absorb waste engine heat and distribute the heated coolant to a heat exchanger, such as a radiator 152 (e.g., radiator heat exchanger). In one example, the coolant may be water. A fan 154 may be coupled to the radiator in order to maintain an airflow through the radiator when the vehicle is moving slowly or stopped while the engine is running. In some examples, fan speed may be controlled by the controller. Coolant which is cooled by the radiator may enter a tank (not shown). The coolant may then be pumped by a water, or coolant, pump 156 back to the engine or to another component of the vehicle system, such as the EGR cooler and/or charge air cooler.

The rail vehicle further includes the controller (e.g., engine controller) to control various components related to the rail vehicle. As an example, various components of the vehicle system may be coupled to the controller via a communication channel or data bus. In one example, the controller includes a computer control system. The controller may additionally or alternatively include a memory holding non-transitory computer readable storage media (not shown) including code for enabling on-board monitoring and control of rail vehicle operation. In some examples, the controller may include more than one controller each in communication with one another, such as a first controller to control the engine and a second controller to control other operating parameters of the locomotive (such as tractive motor load, blower speed, etc.). The first controller may be configured to control various actuators based on output received from the second controller and/or the second controller may be configured to control various actuators based on output received from the first controller.

The controller may receive information from a plurality of sensors and may send control signals to a plurality of actuators. The controller, while overseeing control and management of the engine and/or rail vehicle, may be configured to receive signals from a variety of engine sensors, as further elaborated herein, in order to determine operating parameters and operating conditions, and correspondingly adjust various engine actuators to control operation of the engine and/or rail vehicle. For example, the engine controller may receive signals from various engine sensors including, but not limited to, engine speed, engine load, intake manifold air pressure, boost pressure, exhaust pressure, ambient pressure, ambient temperature, exhaust temperature, particulate filter temperature, particulate filter back pressure, engine coolant pressure, gas temperature in the EGR cooler, or the like. The controller may also receive a signal of an amount of water in the exhaust from an exhaust oxygen sensor 162 and a signal of a sensed oil temperature of the engine from an oil temperature sensor 164. Additional sensors, such as coolant temperature sensors, may be positioned in the thermal management system and will be described further below with reference to FIG. 2B. Correspondingly, the controller may control the engine and/or the rail vehicle by sending commands to various components such as the traction motors, the alternator/generator, fuel injectors, valves, or the like. For example, the controller may control the operation of a restrictive element (e.g., such as a valve) in the thermal management system, as described further below. Other actuators may be coupled to various locations in the rail vehicle.

FIG. 2A shows a schematic of a first example of a thermal management system 150*a*. The thermal management system shown in FIG. 2A may have similar components to those described above with reference to FIG. 1. As such, the similar components are like numbered in FIG. 2A. Additionally, the thermal management system may also be referred to as a cooling system. FIG. 2A shows a plurality of fluid (e.g., coolant) lines that flow coolant (which may be water, in one example) and form a cooling circuit of the thermal management system.

The thermal management system includes a pump 156 (e.g., coolant or water pump). In one example, the pump is a crankshaft driven pump (e.g., driven by an engine crankshaft) that rotates proportionally with engine speed. Additionally, as shown in FIG. 2A, the pump is a single pump providing flow to all the components in the thermal management system.

The pump pumps fluid (e.g., cooled engine coolant) upward through the coolant lines to the engine 104 to provide cooling to engine components. Warmer engine coolant exits the engine and is pumped through a coolant line to an inlet (e.g., inlet line) of the radiator 152 and a secondary heat exchanger 208. The radiator is a radiator heat exchanger which removes heat from the coolant and may be referred to herein as the primary radiator of the thermal management system. The secondary heat exchanger may also be referred to as a sub-cooler or sub-cooler heat exchanger.

The pump then pumps coolant from the inlet to the radiator and through the radiator core. After the radiator, the cooling circuit branches into two parallel return flow paths: a radiator primary return line and a secondary return line. Both the radiator primary return line and the secondary return line flow cooled coolant back to the pump. As such, the pump provides propulsive power to flow coolant through the components in both the return lines. The secondary return line is coupled between the radiator and the pump.

As shown in FIG. 2A, no additional heat exchangers are present in the primary return line. However, the secondary return line includes the secondary heat exchanger 208, and as such may have a higher resistance to coolant flow than the primary return line. Coolant flows through the secondary return line from the radiator, to the secondary heat exchanger, and back to the pump. The secondary heat exchanger may provide additional cooling to the engine coolant, thereby providing sub-cooling to the engine coolant.

The pump may flow coolant downward through the radiator primary return line from the radiator and back to the pump. One or more restrictive (e.g., resistive) elements may be positioned in the radiator primary return line and/or the secondary return line to adjust flow through the two parallel return lines in order to maintain flooding of all components at different engine operating conditions. As shown in FIG. 2A, a restrictive element 220 (e.g., resistive element) is positioned in the radiator primary return line. In one example, the restrictive element is a valve adapted to adjust an amount of coolant flow through the valve and the flow passage in which it is disposed (e.g., the radiator primary return line, as shown in FIG. 2A). The restrictive element may be referred to herein as an idle performance valve. Additional details regarding the restrictive element are provided below.

FIG. 2B shows a more detailed schematic of a second example of a thermal management system 150*b*. The thermal management system shown in FIG. 2B may have similar components to those described above with reference to FIG. 1. As such, the similar components are like numbered in FIG. 2B. The second example of the thermal management system illustrated in FIG. 2B may be one limiting example of the first example of the thermal management system illustrated in FIG. 2A. Additionally, the thermal management system may also be referred to as a cooling system.

The thermal management system includes a pump 156 (e.g., coolant or water pump). In one example, the pump is a crankshaft driven pump (e.g., driven by an engine crankshaft) that rotates proportionally with engine speed. Additionally, as shown in FIG. 2B, the pump is a single pump providing flow to all the components in the thermal management system. More specifically, as one example, the pump is the only pump anywhere in the thermal management system. The pump provides coolant flow to all the thermal management system components. In one example, the coolant pumped through the thermal management system is water. In another example, the coolant in the thermal management system is another type of coolant.

FIG. 2B shows a vertical position of each of the thermal management system components relative to the coolant pump. The vertical height of each component may be relative to a vertical direction 200, where the vertical direction is relative to a surface on which a vehicle in which the engine is installed sits. As such, components with a larger vertical height may be positioned vertically above components with a smaller vertical height. Additionally, FIG. 2B shows a plurality of fluid (e.g., coolant) lines that flow coolant (which may be water, in one example) and form a cooling circuit 201 of the thermal management system.

The pump 156 is positioned at a first position 202. The first position may be a base position from which the vertical heights of all other components or flow conduits (e.g., flow lines) are measured. More specifically, the first position is positioned at a pump inlet of the pump. The pump pumps fluid (e.g., cooled engine coolant) upward through the coolant lines to the engine 104 and the EGR cooler 134 to provide cooling to engine components and exhaust flowing through the EGR cooler. The engine and EGR cooler are positioned in parallel with one another in the cooling circuit, downstream from the pump. Warmer engine coolant exits the engine and the EGR cooler and then rejoins into a heated engine coolant line 203. Warmer engine coolant is pumped through the heated engine coolant line to an inlet 204 (e.g., inlet line) of the radiator 152 and a secondary heat exchanger 208. The radiator is a radiator heat exchanger which removes heat from the coolant and may be referred to herein as the primary radiator of the thermal management system. The inlet to the radiator is at a second position 205. The second position is at a first vertical height above the pump (e.g., distance between the first position and second position). In one example, the first vertical height may be in a range of about seven to eight feet.

The pump then pumps coolant from the inlet to the radiator and through the radiator core. A top corner of the radiator (and the radiator core) is arranged at a third position 206. The third position is at a second vertical height above the pump (e.g., the distance between the first position and third position). The second vertical height is greater than the first vertical height. In one example, the second vertical height may be in a range of about 8.5 to 9.3 feet.

After the radiator, the cooling circuit branches into two parallel return flow paths: a radiator primary return line 207 and a secondary return line 209. Both the radiator primary return line and the secondary return line flow cooled coolant back to the pump. As such, the pump must provide propulsive power to flow coolant through the components in both the return lines. The secondary return line is coupled between the radiator and the pump. Further, the secondary return line includes a plurality of heat exchangers. As shown in FIG. 2B, the secondary return line includes the secondary heat exchanger 208, an oil heat exchanger (e.g., oil cooler) 210, and a water-based intercooler 212. Thus, coolant flows through the secondary return line from the radiator, to the secondary heat exchanger, the oil heat exchanger, and the water-based intercooler. The secondary heat exchanger may provide additional cooling to the engine coolant, thereby providing sub-cooling to the engine coolant, the oil heat exchanger provides cooling to engine oil, and the water-based intercooler provides cooling to intake air after passing through a compressor of a turbocharger.

The radiator primary return line includes fewer components (e.g., heat exchangers) than the secondary return line. As one example, as shown in FIG. 2B, the radiator primary return line includes no additional heat exchangers. As a result of the radiator primary return line having fewer heat exchangers than the secondary return line, the resistance of the radiator primary return line may be lower than the resistance of the secondary return line. Additionally, in some embodiments, a diameter of the radiator primary return line is larger than the diameter of the secondary return line. For example, the radiator primary return may have a diameter of approximately 3 inches while the secondary return line may have a diameter of approximately 2.5 inches. Thus, the radiator primary return line has fewer restrictive elements (e.g., no heat exchangers) and a larger flow path diameter, thereby causing coolant to preferentially flow through the radiator primary return line over the secondary return line.

When the coolant flows through the path of least resistance (radiator primary return line), if the system pressure at the secondary return line is not high enough, the components of the secondary return line may not be flooded with coolant. As referred to herein, flooded components refer to components (such as heat exchangers) which are completely filled with coolant. For example, the cooling tubes of flooded heat exchangers may be completely filled with coolant such that there is no air in the coolant tubes. If the heat exchange components are not flooded with coolant, thermal gradients may form across the heat exchangers and/or coolers. As a result, thermal stress may cause degradation of the thermal management system components. Additionally, the temperature in the heat exchangers may not be homogenous, thereby decreasing the cooling efficiency of each component and the engine cooling system. If the secondary return line loses coolant flow (e.g., coolant flow below a threshold flow is provided to the secondary return line), a difference in temperature between the oil and coolant may result. This difference in temperature may falsely indicate engine component failure and result in the controller 110 shutting down the engine. Pressures in the thermal management system may be based on pump speed at different engine operating conditions and the vertical heights of each component with respect to the pump height. Pump speed and outlet pressure may increase with increasing engine speed (or notch level). In one example, when engine speed is below a threshold (e.g., at engine idle conditions), the pump speed and outlet pressure may not be sufficient to provide flow and flooding to the components of the secondary return line.

Additionally, when the engine is shut off, coolant may be drained from the heat exchangers of the thermal management system in order to reduce the likelihood of freezing within the heat exchangers. As a result, air may fill the cooling tubes of the heat exchangers. Upon engine startup, air within the thermal management system may cause the coolant pump to not build enough pressure. Thus, during an engine starting event (e.g., which includes engine cranking), the coolant pump may not provide enough pressure to move the water/air mixture (or coolant/air mixture) through the cooling circuit and flood all the components (e.g., heat exchangers) of the thermal management system. In particular, it may be difficult to flood the secondary heat exchanger, the oil heat exchanger, and the water-based intercooler at engine startup. As described above, this may cause thermal gradients to form across the un-flooded heat exchangers, thereby resulting in component degradation and non-homogenous temperatures in the thermal management system.

Figure 3:
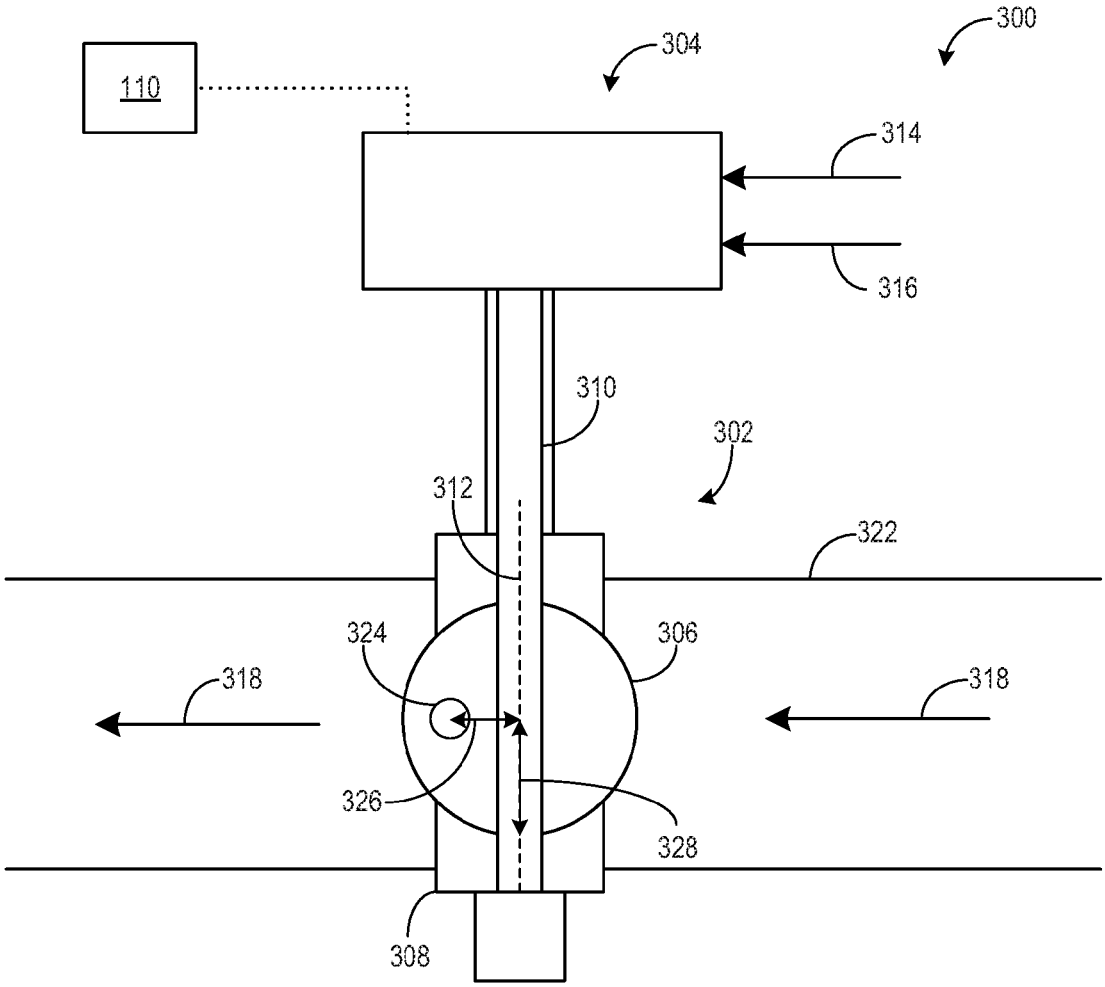
FIG. 3 shows a valve of the thermal management system according to an embodiment of the invention.

Returning to FIG. 2B, the pump may flow coolant downward through the radiator primary return line from the radiator (at the third position) and back to the pump (at the first position). One or more restrictive (e.g., resistive) elements may be positioned in the radiator primary return line and/or the secondary return line to adjust flow through the two parallel return lines in order to maintain flooding of all components at different engine operating conditions. As shown in FIG. 2B, a restrictive element 220 (e.g., resistive element) is positioned in the radiator primary return line. In one example, the restrictive element is a valve adapted to adjust an amount of coolant flow through the valve and the flow passage in which it is disposed (e.g., the radiator primary return line, as shown in FIG. 2B). The restrictive element may be referred to herein as an idle performance valve. As shown in FIG. 3, described further below, the valve may be a butterfly valve movable into two positions: a first (e.g., open) position which allows a greatest amount of flow through the flow passage and a second (e.g., closed) position which at least partially blocks the flow passage and allows a smaller amount of flow through the flow passage. In another example, the restrictive element may be another type of valve or adjustable element that may block a portion of the flow path through the radiator primary return line. For example, the restrictive element may be a flapper valve, a sliding valve, a ball valve, or another type of adjustable valve that may block varying amounts of the flow path in which it is coupled within. As shown in FIG. 2B, the restrictive element is positioned in the radiator primary return line upstream of where the secondary return line re-joins with the radiator primary return line upstream of the pump inlet.

The controller may adjust a position of the restrictive element based on engine operating conditions including engine speed. In some embodiments, following an engine start, the restrictive element may be adjusted only based on engine speed and not based on system temperatures (e.g., engine temperature and/or coolant temperature). For example, when engine speed is at or above a threshold speed, the controller may adjust the restrictive into the first (e.g., open) position. In the first position, the resistance of the radiator primary return line may be smaller than the resistance of the secondary return line. In another example, the first position may be a position that provides minimal to no flow restriction in the radiator primary return line. As such, the first position may allow for unrestricted flow through the radiator primary return line. Alternatively, when engine speed is below the threshold speed, the controller may adjust the restrictive element into the second position. The second position may restrict the flow through the radiator primary return line by a greater amount than when in the first position. In one example, in the second position, the resistance (e.g., flow resistance) of the radiator primary return line may be greater than the resistance of the secondary return line. As a result, more coolant may flow through the secondary return line than the radiator primary return line, thereby providing complete flooding of the heat exchangers in the secondary return line. However, in the second position, coolant may still flow through the radiator primary return line (e.g., via one or more orifices in movable element of the valve, as described further below with reference to FIG. 3). Thus, in one embodiment, no position of the restrictive element ever completely restricts (e.g., blocks) flow through either of the secondary return line or the radiator primary return line. In this embodiment, the resistances of both parallel return lines are always non-zero and flow is always flowing through both the secondary return line and the radiator primary return line at all engine speeds (including engine idle speed). In another example, in the second position, the resistance of the radiator primary return line may not be greater than the resistance of the secondary return line. However, in this example, the resistance of the radiator primary return line is increased from the first position by an amount that provides enough flow and pressure to the secondary return line in order to fully flood the heat exchangers of the secondary return line. Additionally, the controller may adjust the position of the restrictive element according to a certain protocol during an engine start event, as described further below with reference to FIGS. 4 and 5.

In an alternate embodiment, the restrictive element may be positioned in the secondary return line instead of the radiator primary return line. In this example, the controller may adjust the restrictive element to restrict flow through the secondary return line when engine speed is greater than the threshold speed and not restrict flow through the secondary return line when engine speed is less than the threshold speed. The diameters of the two parallel return lines, the restrictive element, and/or the pump settings may be adapted such that when engine speed is below the threshold speed, the resistance through the secondary return line is decreased below the resistance of the radiator primary return line. Further, for a duration following a start of engine cranking during an engine start event, the restrictive element in the secondary return line may be in an open position to decrease the resistance in the secondary return line relative to the radiator primary return line.

As shown in FIG. 2B, the secondary heat exchanger is positioned vertically below the radiator. Coolant flows from the secondary heat exchanger and vertically downward through the secondary return line to the oil heat exchanger. The oil heat exchanger is positioned approximately at fourth position 232 which is higher than the first position but lower than the second position. From the oil heat exchanger, the coolant is pumped vertically upward to the water-based intercooler. The water-based intercooler is positioned approximately at the third position (similar to the height of the top corner of the radiator).

Coolant then flows from the water-based intercooler to the radiator primary return line where the two parallel return lines join into one combined return line 234. The combined return line then carries coolant from both the radiator primary return line and the secondary return line to the pump. In an alternate embodiment, both the radiator primary return line and the secondary return line may join and enter the pump at the pump.

The thermal management system includes one or more coolant (e.g., water) tanks. As shown in FIG. 2B, the thermal management system includes a first water tank 214 positioned vertically above a second water tank 216. The first and second water tanks are positioned in series with one another and fluidly coupled via a water tank connection line 236. A pressure equalizing vent 237 is also coupled between the first water tank and the second water tank. Coolant flows back to the pump from the second water tank via a coolant supply line 238. Further, the two water tanks are positioned at a vertical height that is above the fourth position 232 and below the second position 205.

FIG. 2B also shows several water (e.g., coolant) levels of the first and second water tanks. The first water tank includes a lower, first water level 241 which may represent a lower water level (e.g., when a total water volume of the cooling circuit is at a lower level) during engine shutdown when coolant has been drained from the heat exchangers. The first water tank also includes a higher, second water level 242 which may represented a higher water level during engine shutdown (e.g., when the total water volume of the cooling circuit is at a higher level). During engine shutdown, the second water tank may be completely full. The second water tank includes a lower, first water level 243 which may represent a lower water level when the engine is operating at idle and a higher, second water level 244 which may represent a higher water level when the engine is operating at idle. Thus, during idle, the first water tank may be empty.

The cooling circuit may include one or more orifices. As shown in FIG. 2B, the radiator primary return line includes a first orifice 228 which, in one example, may be approximately 2.5 inches. The secondary return line, downstream from the water-based intercooler, includes a second orifice 230 which, in one example, may be approximately 1.8 inches. In alternate embodiments, the cooling circuit may include more or less than the amount of orifices shown and may have varying sizes.

The thermal management system also includes a vent system for venting air or an air/coolant mixture from various components of the thermal management system (particularly during an engine start event). When the coolant (e.g., water) level in the cooling circuit reaches the third position 206, air in the thermal management system may be fully purged via the vent system. As shown in FIG. 2B, a radiator air vent line 240 is coupled between a top of the radiator and an interior of the first water tank. The radiator air vent line is also fluidly and directly coupled to a squeeze test vent line 246, where the squeeze test vent line is coupled to a portion of the secondary return line which is coupled between the oil heat exchanger and the water-based intercooler (proximate to the outlet of the oil heat exchanger and at the fourth position). As shown in FIG. 2B, the squeeze test vent line includes a third orifice 229 positioned upstream of a squeeze test vent valve 248. A sub-cooler air vent line 250 is coupled between a top of the secondary heat exchanger and the first water tank. Additionally, a water-based intercooler air vent line 252 is coupled between the water-based intercooler and an interior of the second water tank.

The thermal management system also includes a drain system for draining coolant (e.g., water) from the system. As shown in FIG. 2B, a water-based intercooler drain line 254 is coupled between a portion of the secondary return line, the portion located upstream and proximate to an inlet of the water-based intercooler, and an outlet of the water-based intercooler. The drain system also includes a radiator drain line 256 coupled between a bottom of the secondary heat exchanger and the interior of the second water tank and an oil cooler drain line 258 coupled between a bottom of the oil heat exchanger and a primary drain line 260 of the drain system. A water pump drain line 262 is coupled between a bottom of the pump and the primary drain line. The drain system also includes a manual water drain line 264 which includes an automatic water dump valve 266 and a manual water drain valve 268.

The thermal management system includes a variety of sensors sending signals to the controller. The controller may then use these signals to adjust operation of the pump and/or adjust a position of the restrictive element. For example, the engine cooling system may include an engine temperature sensor 222 and one or more engine coolant temperature sensors positioned throughout the engine cooling circuit. As shown in FIG. 2B, engine coolant sensors 224 are positioned in the heated engine coolant line, downstream from the engine, in the radiator primary return line, and the secondary return line, downstream from the water-based intercooler. The engine coolant sensors may measure a temperature and/or flow rate of the coolant through the flow passage which they are coupled to. In alternate embodiments, the engine cooling system may only include one or two of these engine coolant sensors. In another embodiment, the thermal management system may include additional or alternative engine coolant sensors positioned in alternate locations (e.g., downstream from the pump and upstream from the engine). The water tanks may each include a water level sensor 226 indicating a level of coolant in the one or more water tanks.

As shown in FIG. 2B, the radiator, the secondary heat exchanger, and the water-based intercooler are all positioned at similar vertical positions. In one embodiment, the radiator, secondary heat exchanger, and water-based intercooler may all be positioned on an upper radiator rack positioned vertically above the pump, the engine, and the water tanks. Further, as shown in FIG. 2B, the water tanks are positioned vertically below the secondary heat exchanger and the water-based intercooler and vertically above the pump.

Thus, the pump must provide enough pressure to pump coolant to at least the third position (e.g., the second vertical height above the pump). Additionally, this pressure must be sufficient to drive flow through the heat exchangers. In this way, the pump outlet pressure may be based on the second vertical height.

Adjusting the restrictive element (e.g., valve) in the thermal management system to maintain flow through the secondary return line and maintain flooding of the components of the secondary return line during engine operation may decrease thermal gradients across these components and thus the mechanical stress on the components. Additionally, the restrictive element may be adjusted during an engine start event to enable purging of air from an initial flooding of the components of the secondary return line.

FIG. 2B shows example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. Further, elements shown intersecting one another may be referred to as intersecting elements or intersecting one another, in at least one example. Further still, an element shown within another element or shown outside of another element may be referred as such, in one example.

FIG. 3 shows an embodiment of a restrictive element 300, such as restrictive element 220 shown in FIGS. 2A and 2B. As shown in FIG. 3, the restrictive element is a butterfly valve 302 coupled with a pneumatic actuator 304. The butterfly valve includes a valve plate 306 positioned within a housing 308 of the butterfly valve. The housing is coupled to and across a flow passage 322, which may be the radiator primary return line 207 shown in FIG. 2B. Specifically, the valve plate is positioned within an interior of the flow passage. Cooled coolant flowing from a radiator (such as radiator 152 shown in FIGS. 2A and 2B) is shown by arrows 318.

The valve plate is rotatable about a rotational axis 312 via a rotatable rod 310 directly coupled to the valve plate. The rod is directly coupled to the pneumatic actuator. A controller 110 may send an electrical signal (such as an electrical pulse) to the pneumatic actuator. As a result, the pneumatic actuator may receive (or produce) an air pulse into a body of the actuator which results in rotation of the rod and the valve plate. As a result, the valve plate rotates into a different position. As explained above, the valve may include a first position that may be referred to as an open position in which flow within the flow passage is not blocked by the valve plate. In the first position, the flow passage may have a first resistance (which may be a smallest possible resistance). A first air pressure pulse, 314, may actuate the valve plate into the first position. A second air pressure pulse, 316, may actuate the valve plate into a second position which may be referred to as a closed position in which flow within the flow passage is at least partially blocked by the valve plate. In the second position, the flow passage may have a second resistance which is greater than the first resistance. In one example, the first resistance may be in a range of five to six gallons per minute (18-23 liters/minute) and the second resistance may be in a range of 600-700 gallons per minute (2280-2650 liters/minute). In an example, the first resistance may be 5.3 gallons/minute and the second resistance may be 660 gallons/minute (20 liters/minute and 2500 liters/minute, respectively). The resistances disclosed above may each represent an amount of flow (e.g., 5 gallons/minute) that the valve restricts relative to a theoretical maximum flow through the return line, such that when the valve is in the closed position, it restricts flow approximately one hundred times more than when the valve is open.

As shown in FIG. 3, the valve plate includes an orifice 324. The orifice is offset from a vertical centerline (aligned along rotational axis 312) and an outer circumference of the valve plate. Specifically, the orifice is positioned a first distance 326 from the vertical centerline of the valve plate and a second distance 328 from a bottom of the valve plate (the bottom arranged along the outer circumference of the valve plate). As one example, the first distance may be approximately 1.25 inches and the second distance may be approximately 2 inches. In one example, the second distance may be approximately the radius of the valve plate so that the orifice is centered vertically along a diameter of the valve plate and offset from the vertical centerline of the valve plate. In one example, the diameter of the orifice may be in a range of from about 0.45 inches to about 0.55 inches. In another example, the diameter of the orifice may be approximately 0.5 inches. In yet another example, the diameter of the orifice may be in a range of from about 0.4 to about 1 inch. In alternate embodiments, the orifice may have different relative dimensions and positioning within the valve plate. In yet other embodiments, the valve plate may include more than one orifice (for example, one orifice on each side of the vertical centerline). In a still further example, a cutaway on any chord of the valve plate could be removed and/or another orifice geometry could be used (ellipses, etc.). In this way, even when the valve is in the closed, second position, the valve plate never fully blocks the flow of coolant through the flow passage due to the orifice. Said another way, even when the valve plate is closed and positioned across the diameter of the flow passage, at least some coolant may pass through the valve via the orifice and travel downstream in the flow passage.

Figure 4:
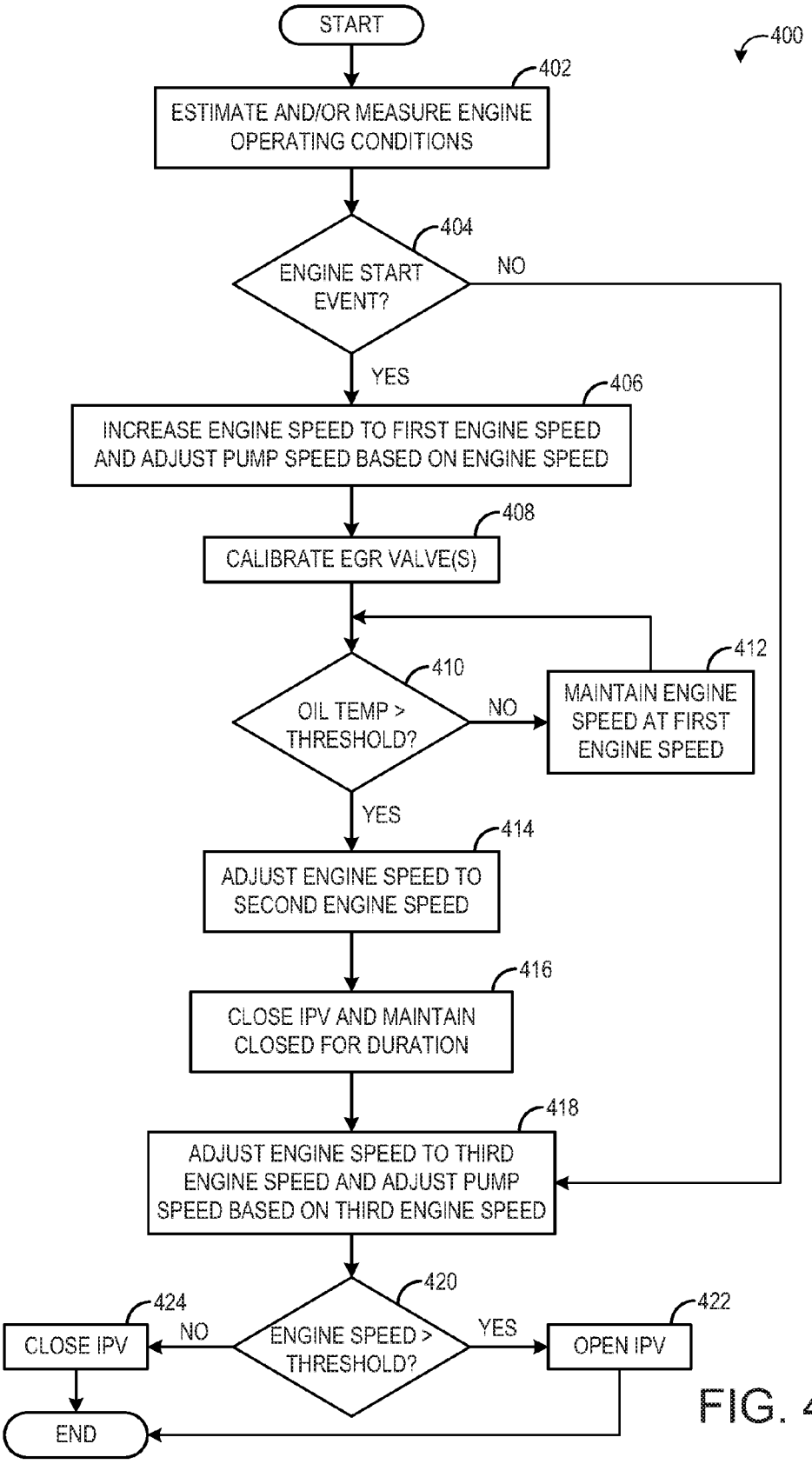
FIG. 4 shows a method for adjusting a restrictive element positioned in the thermal management system according to an embodiment of the invention.

FIG. 4 shows a flow chart of a method 400 for adjusting engine speed and a position of a restrictive element (such as restrictive element 220 or 300 shown in FIGS. 2A and 2B and FIG. 3, respectively) in a thermal management system (such as thermal management system 150 shown in FIGS. 1-2B) during an engine start event. The restrictive element may be referred to below as an idle performance valve (IPV). In the embodiment of method 400, the IPV is positioned in the radiator primary return line (as shown in FIGS. 2A and 2B) that is positioned in parallel with a secondary return line. However, in alternate embodiments, method 400 may be modified for an IPV positioned in the secondary return line (and the opening/closing events of the IPV discussed below may be reversed). Method 400 may be implemented in a system such as the system shown in FIGS. 1-3. Method 400 may be executed by an engine controller (such as controller 110 shown in FIGS. 1 and 3) according to instructions stored on a memory of the controller, in combination with various sensors and actuators of the engine system.

Method 400 begins at 402 by estimating and/or measuring engine operating conditions. Engine operating conditions may include engine speed, engine load, oil temperature, various coolant temperatures in the thermal management system, water (e.g., coolant) levels of one or more water tanks in the thermal management system, engine temperature, ambient pressure, ambient temperature, oil viscosity, an operator torque demand, or the like. At 404, the method includes determining if there is an engine start event. For example, if the engine is off and then the engine is turned on (e.g., via a key-on event), an engine start event may be occurring. An engine start event may include an engine cranking activity that includes cranking the engine via power stored at a battery of a starter motor or alternator/generator of the vehicle in order to turn a crankshaft of the engine. An engine start event may also be referred to herein as a start of engine cranking mode where the engine is being started via engine cranking and not combustion at the engine cylinders. If the engine is currently running (e.g., not off) and not cranking (and thus may be combusting fuel), the method continues to 418 to adjust engine speed to a third engine speed that is based at least in part on a current torque demand of the engine and adjust a pump speed of a coolant pump (such as pump 156 shown in FIGS. 1-2B) based on the third engine speed, as explained further below.

Alternatively at 404, if the engine is starting (or operating in the start of engine cranking mode), the method continues to 406 to increase engine speed to a first engine speed and adjust the coolant pump speed based on the first engine speed. The first engine speed may be a maximum available engine speed for the current oil temperature (e.g., oil temperature below a threshold oil temperature). In one example, the first engine speed may be 440 RPM. In another example, the first engine speed may be 390 RPM. In yet another example, the first engine speed may be less than 580 RPM. Increasing the engine speed at 406 may include increasing the engine speed via rotational power through the crankshaft from the starter motor or alternator/generator. For example, the controller may send a signal to an actuator of the starter motor or alternator/generator indicating a rotational speed that results in the first engine speed. Further, as discussed above, the coolant pump may be a crankshaft-driven pump such that the pump speed adjusts automatically with engine speed. Thus, as engine speed increases, the pump speed may increase. In another example, the pump speed may increase with increasing engine notch level. In alternate embodiments, the controller may adjust pump speed based on one or more of engine speed, coolant temperatures, and/or engine temperatures.

At 408, the method optionally includes calibrating one or more exhaust gas recirculation (EGR) valves (such as EGR valve 136 shown in FIG. 1) during the engine start event. For example, the method at 408 may include calibrating the EGR valve(s) based on position feedback of the EGR valve(s) (received at the controller from one or more positon feedback sensors coupled with the EGR valve(s)) in response to applying a driving current to an actuator of the one or more EGR valve(s). More specifically, via an actuation signal sent from the controller to the actuator of an EGR valve, the EGR valve may be driven to its electrical extremes (e.g., full current or no current) in order to determine the opening and closing feedback of the valve position feedback sensor. Based on the received feedback, the controller may determine a linear relationship between current and position feedback and therefore calibrate the EGR valve. In alternate embodiments, method 400 may not include calibration of the one or more EGR valves.

At 410, the method includes determining whether an oil temperature (e.g., temperature of the engine oil) is greater than a threshold oil temperature. As one example, the oil temperature is sensed via an oil temperature sensor (e.g., oil temperature sensor 164 shown in FIG. 1). The controller may receive an electrical signal from the oil temperature sensor indicating the sensed oil temperature value. The threshold oil temperature may be a temperature above which the engine operates in an idle performance mode or below which the engine operates in a cold oil operating mode. In the cold oil operating mode, engine speed may be maintained at a lower engine speed (e.g., the first engine speed) than in the idle performance mode. In the idle performance mode, the engine speed may be increased from the first engine speed to a second engine speed, as described further below. Alternatively to comparing the oil temperature to a threshold, the method at 410 may include determining an oil viscosity of the engine oil and whether the oil viscosity is greater than a threshold oil viscosity and then adjusting the engine speed based on the oil viscosity.

If the oil temperature is not greater than the threshold oil temperature, the method continues to 412 to maintain the engine speed at the first engine speed. Alternatively, if the oil temperature is greater than the threshold oil temperature, the method continues to 414 to adjust engine speed to a second engine speed, where the second engine speed is greater than the first engine speed. As such, the method at 412 may include the controller sending a signal to the starter motor or alternator/generator to increase the speed of engine cranking and increase the engine speed to the second engine speed. In one example, the second engine speed may be 580 RPM. In another example, the second engine speed may be in a range of about 560 to 600 RPM. In yet another example, the second engine speed may be selected (or adjusted) based on one or more of ambient temperature, ambient pressure, a known cranking resistance, and/or a battery state of charge. The engine speed control described above relies on a successful cranking event. If a successful cranking event does not occur, the engine does not run and fuel flow is stopped. In one example, the increase from the first engine speed to the second engine speed may occur during cranking. In another example, the increase from the first engine speed to the second engine speed may occur after cranking, once the engine has been started.

The method then continues to 416 to close the IPV and maintain the IPV closed for a duration while the engine speed is maintained at the second engine speed. Maintaining the engine speed at the second engine speed may include maintaining the engine speed at the second engine speed, even if an operator of the vehicle demands a higher engine speed. Closing the IPV may include adjusting the IPV into a second position that at least partially blocks flow through the radiator primary return line (e.g., radiator primary return line 207) and adjusts the resistance of the radiator primary return line to a first resistance level. The first resistance level may be larger than a resistance level of the secondary return line (e.g., secondary return line 209). As a result, fluid (e.g., water or a different type of coolant) may be pumped through the fluid lines of the thermal management system and into the secondary return line preferentially over the radiator primary return line, thereby enabling flooding of the heat exchangers in the secondary return line. As one example, closing the IPV may include a controller sending a signal to an actuator (such as pneumatic actuator 304 shown in FIG. 3) of the IPV to rotate a valve plate (such as valve plate 306 shown in FIG. 3) of the IPV into the closed position that positions the valve plate across a diameter of the radiator primary return line (and thus decreases a flow area of the radiator primary return line). Additionally, the duration for which the IPV is closed may be a duration (or amount of time) following the start of engine cranking. The duration may be a set duration such as three minutes, in one example. In another example, the duration may be in a range of about two minutes to about 3.5 minutes. The duration is non-zero and may be set based on an amount of time needed to pump fluid through and flood all of the heat exchangers in the secondary return line. In another example, the duration may be selected (or adjusted) based on one or more of ambient temperature, ambient pressure, a known cranking resistance, and/or a battery state of charge.

After the duration for closing the IPV has expired, the method continues to 418. At 418, the method includes adjusting the engine speed to a third engine speed and adjusting the pump speed to a pump speed level that is based on the third engine speed. As explained above, the pump may be driven by the engine and thus the pump speed increases proportionally with engine speed. The third engine speed may be an engine speed that is based at least in part on a torque demand (or torque load) of the engine. The torque demand may be an operator torque demand. In another example, the third engine speed may be additionally or alternatively based on a fluid flow rate through the thermal management system. For example, the controller may receive a sensed fluid flow rate through the thermal management system from a flow sensor disposed in the flow circuit of the thermal management system. Based on the received fluid flow rate and a received torque demand, the controller may determine the third engine speed and a control signal to send to a fuel injector actuator of the engine to achieve the third engine speed, such as a pulse width of the signal being determined based on a determination of the fluid flow rate and torque demand. More specifically, the controller may make a logical determination of the third engine speed and a fuel value to achieve the third engine speed at the current operating conditions based on logic rules that are a function of the torque demand and flow rate through the thermal management system. The controller may then generate a control signal that is sent to the actuator of the fuel injector to inject the determined fuel value. As one example, the control signal may be a pulse width of fuel to inject into the engine cylinder. The sensed flow rate through the thermal management system may be one or more of a flow rate of fluid (e.g., coolant) through the radiator primary return line, a flow rate of fluid through the secondary return line, and/or or a flow rate of fluid through the heated engine coolant line. As torque demand increases, the third engine speed may increase. Further, if the flow rate through the secondary return line decreases below a threshold (which may be based on a flow rate at which fluid may not reach or completely fill one of the components of the secondary return line), the third engine speed may increase. The method at 418 may include operating in a torque demand mode where the engine speed of the engine is based on torque demand and is no longer maintained at a set level (thus, the engine speed may change as torque demand changes).

At 420, the method includes determining whether the engine speed (e.g., the third engine speed) is greater than a threshold engine speed. The threshold engine speed may be an engine speed below which a system backpressure output by the pump is not sufficient to flood all the heat exchange components of the secondary return line (e.g., the secondary heat exchanger and/or the water-based intercooler). In this way, the threshold engine speed may be based on a threshold pressure required to flood all thermal management system components. In another embodiment, the threshold engine speed may be an engine idle speed. In yet another example, the threshold engine speed may be a threshold speed range. For example, the threshold engine speed range may be a range between engine idle and a second, higher threshold speed (e.g., such as notch 1). When operating at or below the threshold engine speed, the engine speed may be considered below the threshold engine speed. In yet another example, the threshold engine speed may be 540 RPM. In still another example, the threshold engine speed may be 520 RPM.

If the engine speed is greater than the threshold engine speed, the method continues to 422 to open the IPV disposed in the radiator primary return line. Opening the IPV may including adjusting the IPV into a first position that does not block flow through the radiator primary return line and adjusts the resistance of the radiator primary return line to a second resistance level that is lower than the first resistance level discussed above at 416. The method at 422 may include decreasing the resistance of the radiator primary return line relative to the secondary return line. In the open position, the valve plate of the IPV may not block flow through the radiator primary return line.

In one example, the first resistance level may be in a range of 600-700 gallons/minute (2280-2650 liters/minute) and the second resistance level may be in a range of 5-6 gallons/minute (18-23 liters/minute). In another example, the first resistance level may be 125% higher than the second resistance level. In yet another example, adjusting the resistance of the radiator primary return line from the second resistance level to the first resistance level may result in a decrease in the amount of flow through the radiator primary return line (and thus a corresponding increase in flow through the secondary return line), such as a decrease of 125%. Additionally, in the closed position, the IPV may be 100% closed but still allow a small amount of flow through the valve via one or more orifices disposed in a valve plate of the IPV. In another example, in the open position, the IPV may be 100% open.

Alternatively at 420, if the engine speed is not greater than the threshold engine speed, the method continues to 424. At 424, the method includes closing the IPV. As explained above at 416, closing the IPV includes moving the IPV into the second position that at least partially blocks fluid flow through the radiator primary return line (e.g., the only flow that passes through the valve is through the one or more orifices disposed in the valve plate of the valve, as shown in FIG. 3). The method at 424 may include increasing the resistance of the radiator primary return line relative to the secondary return line. As a result, more fluid may flow through the secondary return line and flood the components of the secondary return line.

Turning to FIG. 5, a graph 500 is shown illustrating adjustments to engine speed (e.g., RPM) and a position of an IPV (such as restrictive element 220 shown in FIGS. 2A and 2B and/or restrictive element 300 shown in FIG. 3) during an engine start event. Specifically, graph 500 shows changes in engine speed at plot 502, changes in oil temperature at plot 504, changes in engine water (e.g., coolant) inlet pressure (e.g., the pressure of water or coolant entering the engine from the coolant pump) at plot 506, and changes in a position of the IPV at plot 508. The oil temperature may be a sensed oil temperature measured via an oil temperature sensor coupled to the engine. Additionally, the IPV may be positioned in a radiator primary return line, as shown in FIG. 2B, and the open position may be a position where a valve plate of the IPV does not block flow through the radiator primary return line and the closed position may be a position where the valve plate of the IPV blocks flow through the radiator primary return line (except for a small amount of flow that may pass through one or more orifices in the valve plate). Further, the open position may result in a lower flow resistance through the radiator primary return line than when the IPV is in the closed position.

At time t0 an engine start event may begin (e.g., the engine may be turned on and an engine cranking activity may begin). Engine speed is increased to a first engine speed, S1, (plot 502) and the oil temperature begins to rise (plot 504). The IPV is closed (plot 508) and the engine water inlet pressure gradually increase (plot 506). At time t1, the oil temperature increases above a threshold oil temperature, T2 (plot 504). In response to the oil temperature increasing above the threshold oil temperature T2, the controller commands the engine speed to increase to the second engine speed, S2. The second engine speed is greater than a threshold engine speed, T1. The engine speed is maintained at the second engine speed S2 for a duration D1 after the start of engine cranking. Between time t1 and time t2, the engine water inlet pressure increases due to the IPV being closed while the engine speed is maintained at the second engine speed S2 (plot 506).

After the duration, engine speed is increased to a third engine speed that is based on a torque demand of the engine (plot 502). In this way, at time t2, the controller sends a command to increase engine speed to a level demanded via an operator of the engine. Thus, the engine speed is no longer maintained at a set level. Additionally, after time t2, the position of the IPV is controlled based on engine speed relative to the threshold engine speed T1. Thus, since all components of the thermal management system may be flooded after the duration, the IPV may be opened if the engine speed is high enough to maintain the flooding. For example, since the engine speed is greater than the threshold engine speed T1 between time t2 and time t3, the IPV is actuated into and maintained in the open position. As a result, a resistance of the radiator primary return path may decrease. At time t3, engine speed decrease below the threshold engine speed T1 and thus the controller sends a signal to close the IPV. Then, at time t4, the engine speed increases above the threshold engine speed T1 and in response, the controller sends a signal to an actuator of the IPV to open the IPV.

In this way, by controlling engine speed to a set level and closing a restrictive element in a radiator primary return line of a thermal management system during an engine start event, a fluid pressure within the fluid passages of the thermal management system may increase. As a result, air accumulated within components (e.g., heat exchangers) of the thermal management system during an engine off period (prior to the engine start event) may be purged from the components and fluid (e.g., coolant) may flood the components. For example, closing the restrictive element may decreases a resistance of a secondary return line arranged in parallel with the radiator primary return line and including more heat exchangers than the radiator primary return line. The technical effect of adjusting the engine speed of the engine during an engine start event from a first engine speed to a second engine speed, where the adjusting is based at least in part on a sensed oil temperature; adjusting a first resistance of a radiator primary return line of a thermal management system of the engine to a first resistance level is to purge air from the components of the thermal management system and flood the components with heat transfer fluid. Additionally, the technical effect of adjusting the engine speed a duration after a start of the engine cranking from the second engine speed to a third engine speed, the third engine speed based at least in part on a torque demand of the engine, and selectively adjusting the first resistance between each of the first resistance level and a second resistance level based at least in part on the third engine speed, the second resistance level being lower than the first resistance level is to maintain the components of the thermal management system flooded during engine operation, thereby reducing thermal gradients across the components and reducing component degradation.

As one embodiment, a method for an engine includes adjusting an engine speed of the engine during an engine start event that includes an engine cranking activity from a first engine speed to a second engine speed, where the adjusting is based at least in part on a sensed oil temperature; adjusting a first resistance of a radiator primary return line of a thermal management system of the engine to a first resistance level; and adjusting the engine speed a duration after a start of the engine cranking from the second engine speed to a third engine speed, the third engine speed based at least in part on a torque demand of the engine, and selectively adjusting the first resistance between each of the first resistance level and a second resistance level based at least in part on the third engine speed, the second resistance level being lower than the first resistance level.

In an example, adjusting the engine speed of the engine from the first engine speed to the second engine speed based at least in part on the sensed oil temperature includes adjusting the engine speed to the first engine speed, in response to the oil temperature being below a threshold oil temperature, to operate in a cold oil operating mode, and adjusting the engine speed to the second engine speed, in response to the oil temperature being above or at the threshold oil temperature, to operate in an idle performance mode, the second engine speed greater than the first engine speed. In an example, adjusting the engine speed to the third engine speed includes operating the engine in a torque demand mode.

In an example, the first resistance level is greater than a second resistance of a secondary return line, the secondary return line arranged in parallel with the radiator primary return line in the thermal management system. Adjusting the first resistance of the radiator primary return line to the first resistance level may include adjusting a valve disposed in the radiator primary return line, upstream of a coolant pump of the thermal management system, into a closed position that increases a flow of coolant to the coolant pump via the secondary return line. Adjusting the first resistance between each of the first resistance level and the second resistance level may include adjusting the valve into the closed position or an open position that increases the flow of coolant to the coolant pump via the radiator primary return line.

In an example, the first resistance and the second resistance are each non-zero, engine fluid may be supplied to each of the radiator primary return line and the secondary return line by a pump in the thermal management system, and the pump may be a crankshaft driven pump that rotates proportionally with engine speed.

An inlet to each of the radiator primary return line and the secondary return line may be downstream from a radiator of the thermal management system, one or more engine coolant tanks may be positioned vertically above the pump, and the radiator and a secondary heat exchanger disposed in the secondary return line are positioned vertically above the one or more engine coolant tanks.

In an example, selectively adjusting the first resistance includes adjusting the first resistance to the first resistance level in response to the engine speed being below a first threshold speed and adjusting the first resistance to the second resistance level in response to the engine speed being above the first threshold speed.

In an example, adjusting the engine speed based at least in part on the sensed oil temperature begins at the start of engine cranking and includes adjusting the engine speed based on oil temperature only and not based on torque demand. In an example, the method further includes, during the engine start, calibrating a position of one or more exhaust valves in an engine system based on position feedback of the one or more exhaust valves in response to applying a driving current to the one or more exhaust valves.

In an example, one or more of the second engine speed or the duration are selected based on one or more of ambient temperature, ambient pressure, a known cranking resistance, or a battery state of charge.

As another embodiment, a method for an engine includes adjusting engine speed to a first speed level at a start of an engine cranking mode; sensing an engine operating parameter; increasing the engine speed to a second speed level in response to the sensed engine operating parameter changing beyond a determined threshold level, and maintaining the engine speed at the second speed level for a determined duration, where the second speed level is higher than the first speed level; sensing a fluid flow rate through a thermal management system for the engine; and adjusting the engine speed to a third speed level after the duration, where the third speed level is based at least in part on a torque request to the engine and the sensed fluid flow rate through the thermal management system.

In an example, maintaining the engine speed at the second speed level for the duration includes maintaining the engine speed at the second speed level even if commanded to a higher, fourth speed level by an operator.

The method may further include adjusting a resistance of a radiator primary return line arranged in parallel with a secondary return line of the thermal management system. The resistance may be adjusted from a lower, first resistance level to a higher, second resistance level in response to the duration being exceeded. The radiator primary return line may be coupled between a radiator and a coolant pump of the thermal management system, and the secondary return line may be arranged between the radiator and coolant pump and include a secondary heat exchanger and a third heat exchanger. The secondary heat exchanger may be positioned vertically above one or more coolant tanks of the thermal management system.

The method may further include, after the duration, selectively adjusting the resistance between the first resistance level and the second resistance level based on the third speed level. Adjusting the resistance of the radiator primary return line to the first resistance level may include adjusting a position of a valve disposed in the radiator primary return line into a first position. The valve in the first position increases the resistance of the radiator primary return line relative to a resistance of the secondary return line. Adjusting the resistance of the radiator primary return line to the second resistance level may include adjusting the position of the valve into a second position that decreases the resistance of the radiator primary return line relative to the resistance of the secondary return line.

As yet another embodiment, a system for an engine includes a single coolant pump driven by an engine crankshaft; an engine positioned downstream from the single coolant pump; a radiator positioned downstream from the engine; a radiator primary return line coupled between the radiator and the single coolant pump, the radiator primary return line including a restrictive element; a secondary return line arranged in parallel with the radiator primary return line; and a controller. The controller is configured to, in response to a start of engine cranking, adjust a position of the restrictive element to a set, first resistance level and adjust engine speed to a first speed, the first speed selected based on oil temperature only; and a duration after the start of engine cranking, adjust the engine speed based on torque demand and selectively adjust the position of the restrictive element between each of the first resistance level and a second resistance level based on the engine speed, the second resistance level lower than the first resistance level.

The system may further comprise an EGR cooler positioned in parallel with the engine, wherein the EGR cooler is positioned vertically above the single coolant pump with respect to a ground on which a vehicle in which the engine cooling system is installed sits, and wherein the radiator is positioned vertically above the EGR cooler.

In an example, the secondary return line includes a secondary heat exchanger, an oil heat exchanger, and a water-based intercooler. The secondary heat exchanger may be a sub-cooler of the radiator, such that some coolant that flows through the radiator flows through the secondary heat exchanger before flowing to the oil heat exchanger and/or water-based intercooler. The radiator may be positioned vertically above the secondary heat exchanger and the secondary heat exchanger may be positioned vertically above the oil heat exchanger and the single coolant pump.

In an example, the restrictive element includes a valve plate including an orifice, where a diameter of the orifice is smaller than a radius of the valve plate, and wherein the valve plate is movable between a first position restricting flow through the radiator primary return line and a second position allowing unrestricted flow through the radiator primary return line. The orifice is positioned on one side of the valve plate, relative to a rotational axis of the valve plate, and the diameter of the orifice may be in a range of from about 0.45 inches to about 0.55 inches. As used herein, about may be refer to values within a threshold range of a given value. For example, about 0.45 inches may include diameters of the orifice within 5% of 0.45 (e.g., about 0.45 inches may include 0.43 inches, 0.47 inches, etc.).

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for an engine, comprising:

adjusting an engine speed of the engine during an engine start event that includes an engine cranking activity from a first engine speed to a second engine speed, where the adjusting is based at least in part on a sensed oil temperature;

adjusting a first resistance of a radiator primary return line of a thermal management system of the engine to a first resistance level; and adjusting the engine speed a duration after a start of the engine cranking from the second engine speed to a third engine speed, the third engine speed based at least in part on a torque demand of the engine, and selectively adjusting the first resistance between each of the first resistance level and a second resistance level based at least in part on the third engine speed, the second resistance level being lower than the first resistance level.

2. The method of claim 1, wherein adjusting the engine speed of the engine from the first engine speed to the second engine speed based at least in part on the sensed oil temperature includes adjusting the engine speed to the first engine speed, in response to the oil temperature being below a threshold oil temperature, to operate in a cold oil operating mode and adjusting the engine speed to the second engine speed, in response to the oil temperature being above or at the threshold oil temperature, to operate in an idle performance mode, the second engine speed greater than the first engine speed, and wherein adjusting the engine speed to the third engine speed includes operating the engine in a torque demand mode.

3. The method of claim 1, wherein the first resistance level is greater than a second resistance of a secondary return line, the secondary return line arranged in parallel with the radiator primary return line in the thermal management system.

4. The method of claim 3, wherein adjusting the first resistance of the radiator primary return line to the first resistance level includes adjusting a valve disposed in the radiator primary return line, upstream of a coolant pump of the thermal management system, into a closed position that increases a flow of coolant to the coolant pump via the secondary return line and wherein adjusting the first resistance between each of the first resistance level and the second resistance level includes adjusting the valve into the closed position or an open position that increases the flow of coolant to the coolant pump via the radiator primary return line.

5. The method of claim 3, wherein the first resistance and the second resistance are each non-zero, wherein engine fluid is supplied to each of the radiator primary return line and the secondary return line by a pump in the thermal management system, and wherein the pump is a crankshaft driven pump that rotates proportionally with engine speed.

6. The method of claim 5, wherein an inlet to each of the radiator primary return line and the secondary return line is downstream from a radiator of the thermal management system, wherein one or more engine coolant tanks are positioned vertically above the pump, and wherein the radiator and a secondary heat exchanger disposed in the secondary return line are positioned vertically above the one or more engine coolant tanks.

7. The method of claim 1, wherein selectively adjusting the first resistance includes adjusting the first resistance to the first resistance level in response to the engine speed being below a first threshold speed and adjusting the first resistance to the second resistance level in response to the engine speed being above the first threshold speed.

8. The method of claim 1, wherein adjusting the engine speed based at least in part on the sensed oil temperature begins at the start of engine cranking and includes adjusting the engine speed based on oil temperature only and not based on torque demand.

9. The method of claim 1, further comprising, during the engine start, calibrating a position of one or more exhaust valves in an engine system based on position feedback of the one or more exhaust valves in response to applying a driving current to the one or more exhaust valves.

10. The method of claim 1, wherein one or more of the second engine speed or the duration are selected based on one or more of ambient temperature, ambient pressure, a known cranking resistance, or a battery state of charge.

11. A method for an engine, comprising:

adjusting engine speed to a first speed level at a start of an engine cranking mode;

sensing an engine operating parameter;

increasing the engine speed to a second speed level in response to the sensed engine operating parameter changing beyond a determined threshold level, and maintaining the engine speed at the second speed level for a determined duration, where the second speed level is higher than the first speed level;

sensing a fluid flow rate through a thermal management system for the engine; and adjusting the engine speed to a third speed level after the duration, where the third speed level is based at least in part on a torque request to the engine and the sensed fluid flow rate through the thermal management system.

12. The method of claim 11, wherein maintaining the engine speed at the second speed level for the duration includes maintaining the engine speed at the second speed level even if commanded to a higher, fourth speed level by an operator.

13. The method of claim 11, further comprising adjusting a resistance of a radiator primary return line arranged in parallel with a secondary return line of the thermal management system from a lower, first resistance level to a higher, second resistance level in response to the duration being exceeded, wherein the radiator primary return line is coupled between a radiator and a coolant pump of the thermal management system, and wherein the secondary return line is arranged between the radiator and coolant pump and includes a secondary heat exchanger and a third heat exchanger, wherein the secondary heat exchanger is positioned vertically above one or more coolant tanks of the thermal management system.

14. The method of claim 13, further comprising, after the duration, selectively adjusting the resistance between the first resistance level and the second resistance level based on the third speed level and wherein adjusting the resistance of the radiator primary return line to the first resistance level includes adjusting a position of a valve disposed in the radiator primary return line into a first position that increases the resistance of the radiator primary return line relative to a resistance of the secondary return line and wherein adjusting the resistance of the radiator primary return line to the second resistance level includes adjusting the position of the valve into a second position that decreases the resistance of the radiator primary return line relative to the resistance of the secondary return line.

15. A system for an engine, comprising a single coolant pump driven by an engine crankshaft;

an engine positioned downstream from the single coolant pump;

a radiator positioned downstream from the engine;

a radiator primary return line coupled between the radiator and the single coolant pump, the radiator primary return line including a restrictive element;

a secondary return line arranged in parallel with the radiator primary return line; and a controller configured to:

in response to a start of engine cranking, adjust a position of the restrictive element to a set, first resistance level and adjust engine speed to a first speed, the first speed selected based on oil temperature only; and a duration after the start of engine cranking, adjust the engine speed based on torque demand and selectively adjust the position of the restrictive element between each of the first resistance level and a second resistance level based on the engine speed, the second resistance level lower than the first resistance level.

16. The system of claim 15, further comprising an EGR cooler positioned in parallel with the engine, wherein the EGR cooler is positioned vertically above the single coolant pump with respect to a ground on which a vehicle in which the engine cooling system is installed sits and wherein the radiator is positioned vertically above the EGR cooler.

17. The system of claim 15, wherein the secondary return line includes a secondary heat exchanger, an oil heat exchanger, and a water-based intercooler.

18. The system of claim 17, wherein the radiator is positioned vertically above the secondary heat exchanger and wherein the secondary heat exchanger is positioned vertically above the oil heat exchanger and the single coolant pump.

19. The system of claim 15, wherein the restrictive element includes a valve plate including an orifice, where a diameter of the orifice is smaller than a radius of the valve plate, and wherein the valve plate is movable between a first position restricting flow through the radiator primary return line and a second position allowing unrestricted flow through the radiator primary return line.

20. The system of claim 19, wherein the orifice is positioned on one side of the valve plate, relative to a rotational axis of the valve plate, and wherein the diameter of the orifice is in a range of from about 0.45 inches to about 0.55 inches.

* * * * *